US007636534B2

(12) United States Patent
Manzer

(10) Patent No.: US 7,636,534 B2
(45) Date of Patent: Dec. 22, 2009

(54) METHOD AND DEVICE FOR PRINTING INDIVIDUAL SHEETS WITH FIRST AND SECOND PRINTING GROUPS AND AN INVERTER DEVICE

(75) Inventor: Hans Manzer, Seefeld (DE)

(73) Assignee: Oce Printing Systems GmbH, Poing (DE)

( * ) Notice: Subject to any disclaimer, the term of this patent is extended or adjusted under 35 U.S.C. 154(b) by 787 days.

(21) Appl. No.: 10/508,112

(22) PCT Filed: Mar. 21, 2003

(86) PCT No.: PCT/EP03/02989

§ 371 (c)(1),
(2), (4) Date: Mar. 22, 2005

(87) PCT Pub. No.: WO03/081343

PCT Pub. Date: Oct. 2, 2003

(65) Prior Publication Data

US 2005/0175384 A1 Aug. 11, 2005

(30) Foreign Application Priority Data

Mar. 22, 2002 (DE) ..... 102 12 840

(51) Int. Cl.
*G03G 15/00* (2006.01)

(52) U.S. Cl. ..... 399/223; 399/401

(58) Field of Classification Search ..... 544/186, 544/1, 242, 224; 546/1, 249, 250; 548/1, 548/100, 497, 501, 502; 399/223, 401, 231
See application file for complete search history.

(56) References Cited

U.S. PATENT DOCUMENTS 4,591,884 A * 5/1986 Miyamoto et al. ..... 347/153

(Continued)

FOREIGN PATENT DOCUMENTS

DE 39 06 630 9/1989

(Continued)

OTHER PUBLICATIONS

Xerox Disclosure Journal Tandem Development System vol. 22, No. 4 Jul./Aug. 1997 p. 197-200.

*Primary Examiner*—Quana M Grainger
(74) *Attorney, Agent, or Firm*—Schiff Hardin LLP

(57) ABSTRACT

In a method and system for printing, individual pages of a print medium are transported. With a printing unit, a side of the respective individual page facing it is printed and the applied toner image is fixed. With an inverter, the individual pages with the fixed toner image are inverted after the first printing event and resupplied to the printing unit for printing on an other side. The printing unit has first and second printing groups respectively comprising first and second exposure units, first and second charge corona devices, and first and second developer stations. Individual pages are supplied in succession to both of the first and second printing groups, and the printing groups respectively print two varicolored print images on the same side of the same individual page. A first latent image charge inked by the first developer station with toner of a first color is generated in each of the first and second printing units given a circulation of the intermediate carrier with aid of the first charge corona device and the first exposure unit. The second charge corona device and the second exposure unit subsequently generate a second latent charge image superimposed on the inked first latent charge image. The second charge image is inked by the second developer station with a toner of a second color.

19 Claims, 3 Drawing Sheets

U.S. PATENT DOCUMENTS

| | | | | |
|---|---|---|---|---|
| 4,814,798 | A | 3/1989 | Fukae et al. | |
| 4,994,858 | A | 2/1991 | Lubberts | |
| 5,179,395 | A * | 1/1993 | Kato | 347/119 |
| 5,473,421 | A | 12/1995 | Maruyama et al. | |
| 5,526,107 | A | 6/1996 | Bronstein | |
| 5,598,257 | A | 1/1997 | Keller et al. | |
| 5,640,652 | A | 6/1997 | Nagase et al. | |
| 5,710,968 | A | 1/1998 | Clark et al. | |
| 5,985,499 | A | 11/1999 | Guth et al. | |
| 6,141,523 | A | 10/2000 | Bergmann et al. | |
| 6,212,357 | B1 | 4/2001 | Boehmer et al. | |
| 6,445,899 | B2 | 9/2002 | Sato | |
| 6,762,321 | B2 * | 7/2004 | Sakaguchi | 564/180 |
| 2002/0081120 | A1 * | 6/2002 | Oberhoffner | 399/2 |
| 2005/0158089 | A1 * | 7/2005 | Amarakoon | 399/341 |

FOREIGN PATENT DOCUMENTS

| | | |
|---|---|---|
| DE | 39 35 231 | 4/1990 |
| EP | 0 494 108 | 7/1992 |
| EP | 0 433 444 | 5/1994 |
| EP | 0 629 931 | 12/1994 |
| GB | 2 224 013 | 4/1990 |
| JP | 6-266175 | 9/1994 |
| JP | 7-230192 | 8/1995 |
| JP | 8-339109 | 12/1996 |
| JP | 9-127739 | 5/1997 |
| WO | WO 98/18052 | 4/1998 |
| WO | WO 98/27465 | 6/1998 |
| WO | WO 98/27466 | 6/1998 |
| WO | WO 99/09459 | 2/1999 |

* cited by examiner

METHOD AND DEVICE FOR PRINTING INDIVIDUAL SHEETS WITH FIRST AND SECOND PRINTING GROUPS AND AN INVERTER DEVICE

BACKGROUND

The preferred embodiment of the method and device concerns an electrophotographic printing device, in particular a printer or copier, in which at least one printing group is used that comprises at least two exposure units, at least two charge corona devices and at least two developer stations that are arranged along the circumference of a toner intermediate carrier. The preferred embodiment also concerns a method for printing.

In a conventional printing device, a latent image is applied on a toner intermediate carrier with the aid of an electrophotographic method, for example via exposure of a photoconductor or via magnetization of a magnetically sensitive layer. Toner accumulates on the latent image according to the image-shaped distribution of the electrical charges or of the magnetic field lines. The toner is then transferred to the transfer printing location on a carrier material, for example a paper web. The toner image is later affixed to the carrier material.

In modern printing technology, it is required that a single device prints the carrier material on both sides with high speed. This operating mode is generally designated as duplex printing. The operating mode "spot color printing" or "two-color printing" is also required, in that the carrier material is printed two-color on both sides. Moreover, the requirement exists of a full-color printing with the four process colors "yellow, magenta, cyan and black". In order, for example, to realize the operating mode duplex printing, it is known to first print a continuous carrier web on one side, then to invert the carrier web and to print the second side with the same printing group. The transport path of the carrier web in the printer and in the necessary web inverter device is relatively long and requires a complicated and also error-prone transport device for the carrier material.

A further disadvantage is that the still un-fixed toner image on the one side of the carrier web can be smeared upon transport and thus the print quality is impaired or waste is produced. In order to prevent this, an intermediate fixing of the toner image can occur, whereby however the technical effort is increased. Due to the long transport path between the first transfer printing location for the first transfer printing of a toner image and the second transfer printing location, compliance with high precision registration of the carrier web can only be ensured with high technical effort.

From U.S. Pat. No. 6,141,523 (corresponding to the parallel WO 98/27466) by the same applicant, an electrophotographic printing device is known that comprises two identical printing groups whose transfer printing locations are arranged opposite one another. A continuous carrier web is directed through both printing groups and the front side and the backside of the carrier web are simultaneously printed. The printing groups can respectively contain a plurality of exposure units and a plurality of developer stations, such that a multicolor print can be realized on each side of the continuous carrier web. The aforementioned document is herewith incorporated by reference into the disclosure content of the present application.

From EP 0 629 931 A1 (applicant: XEIKON), an electrostatic printer is known in which a continuous carrier web is directed in the vertical direction between a plurality of toner image carriers. Each toner image carrier has a device generating a toner image. The toner is transferred from the toner image carrier to the carrier web at each transfer printing location. Via two-sided arrangement of toner image carriers along the vertically-running characteristic quantity, a duplex printing with various toner colors is possible.

From EP 0 433 444 B1 (applicant: Eastman Kodak Company), a printer is also known in which a plurality of developer stations are arranged along a photoconductor band as a toner image carrier. Each developer station can ink the charge image generated by an exposure station with toner of a predetermined color. The toner image generated on the photoconductor band is then transferred to the carrier material at a single transfer printing location.

From WO 98/18052 by the same applicant, a printing device with two similar printing groups is known to which individual pages are supplied via a common input. The individual pages are supplied to both printing groups in the printing device via guideways, such that both the front side and the back side of the individual pages are printed given a single pass of the individual pages through the printing device. For this, the transport paths for the individual pages are connected to two rings via connection paths. Each ring contains a printing group. The individual pages can be supplied to the one ring or the other ring and can also traverse both rings in succession, whereby an inversion of the individual pages can optionally also occur. In this document, inverter devices are also specified. This document is likewise included by reference in the disclosure contents of the present patent application.

From U.S. Pat. No. 5,526,107, a color printer is known which comprises a printing group with a printing roller. The printing roller prints an image on one page side at a first transfer printing location and, given further transport, this same printing roller prints an image on the other page side at a second transfer printing location opposite the first transfer printing location. The page is inverted during the transport.

A tandem development system is known from Xerox Disclosure Journal 22, Nr. 4, pg. 197-200. Successive toner images are superimposed on a band-shaped image carrier for printing of a color image. These superimposed toner images are transferred to a carrier material.

WO 98/27465, DE-A-39 06 630, DE-A-39 35 231 and WO 99/09459 are referenced as further prior art.

SUMMARY

It is an object to specify a printing device and a method that allows a duplex printing operation with one color or a plurality of colors to be realized with high efficiency.

In a method and system for printing, individual pages of a print medium are transported. With a printing unit, a side of the respective individual page facing it is printed and the applied toner image is fixed. With an inverter, the individual pages with the fixed toner image are inverted after the first printing event and resupplied to the printing unit for printing on an other side. The printing unit has first and second printing groups respectively comprising first and second exposure units, first and second charge corona devices, and first and second developer stations. Individual pages are supplied in succession to both of the first and second printing groups, and the printing groups respectively print two varicolored print images on the same side of the same individual page. A first latent image charge inked by the first developer station with toner of a first color is generated in each of the first and second printing units given a circulation of the intermediate carrier with aid of the first charge corona device and the first exposure unit. The second charge corona device and the second exposure unit subsequently generate a second latent charge image superimposed on the inked first latent charge image. The second charge image is inked by the second developer station with a toner of a second color.

DESCRIPTION OF THE PREFERRED EMBODIMENTS

Figure 1:
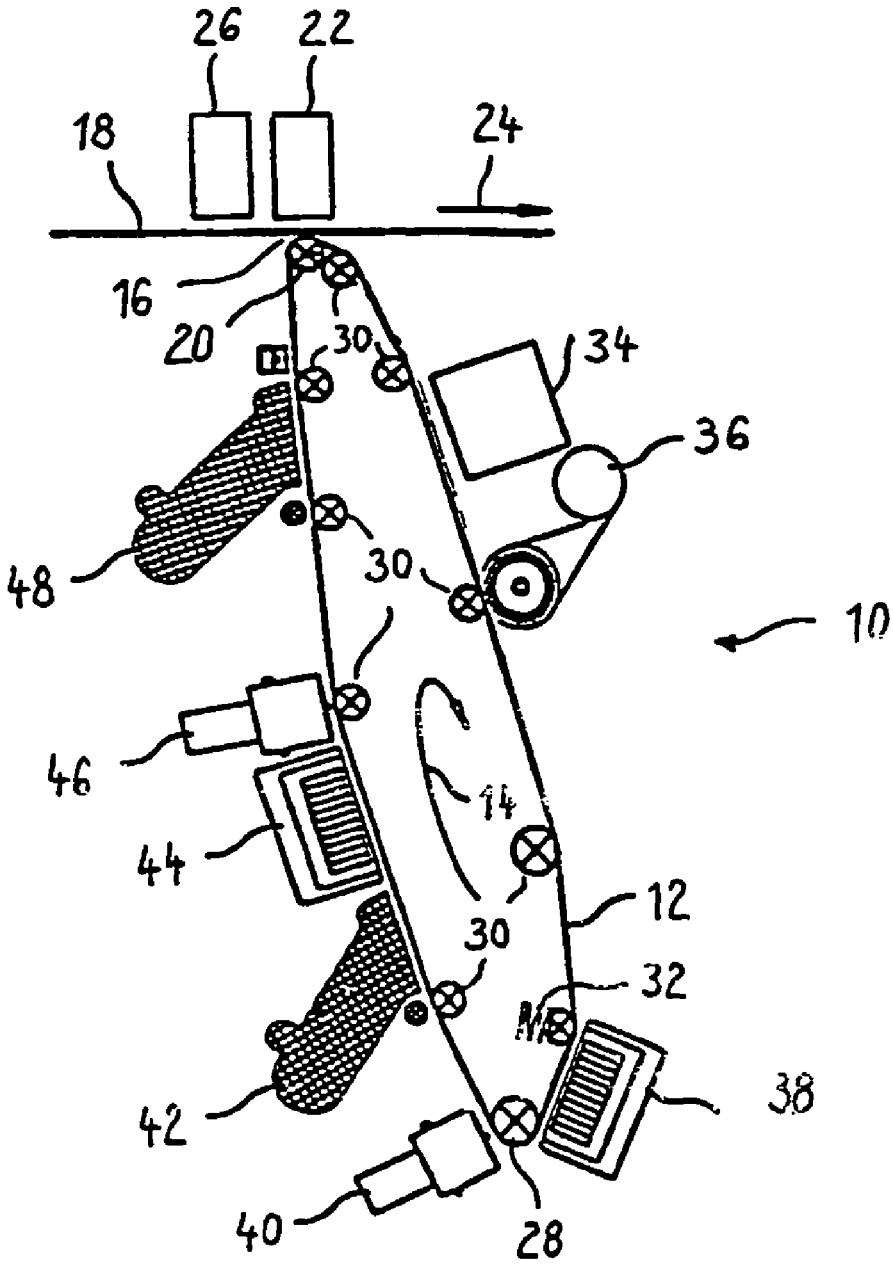
FIG. 1 is a typical design of a printing group with two developer stations.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

According to the preferred embodiment, individual pages are used as a carrier material. With the aid of such individual pages, a high flexibility can be achieved in the print jobs. For example, with the aid of individual pages rapidly alternating jobs can be implemented in a simple manner and different paper qualities, different print formats and also different carrier materials can be used. The waste (also called spoilage) occurring given continuous webs is entirely prevented.

According to the preferred embodiment, an inverter is provided that inverts the individual pages after a first printing event and re-supplies them to the printing unit for printing on the other side. Due to the use of individual pages, this inverter can be arranged relatively close to the printing unit, whereby a compact design results. The printing unit comprises at least one printing group that in turn comprises at least two exposure units, at least two charge corona devices and at least two developer stations that are arranged along the extent of the toner intermediate carrier. Both a one-color print and a multicolor print can be realized on both sides of the individual pages in this manner.

A continuous toner carrier band is preferably used as a toner intermediate carrier, along the extent of which are arranged the image generation devices. Due to the possible arrangement of the toner carrier band as a long stretched-out loop, here a more compact design for the entire printing device can also be realized.

In FIG. 1, a printing group 10 is schematically shown that (as is described further below) can be used in a printing unit. The printing group 10 has a photoconductor band 12 whose outer peripheral surface can be charged with latent charge images, as this known from electrophotography. Under rotation, the photoconductor band 12 is directed in the direction of the arrow 14 to a transfer printing location 16 in order to transfer a toner image to an individual page 18. A transfer roller 20 is arranged opposite a transfer printing corotron 22 which attaches the toner particles on the photoconductor band 12 onto the surface of the individual page 18 via the effect of an electrostatic force field, such that a toner image that can still be smeared is created on the individual page 18.

Viewed in the transport direction 24 of the individual page 18, a conditioner corotron 26 which places the individual page 18 into a defined electrostatic output state is upstream from the transfer printing corotron 22.

Arranged opposite the transfer roller 20 is a deflection roller 28 that deflects the photoconductor web 12. The photoconductor web 12 is designed as an elongated loop whose longitudinal axis runs significantly vertical. It is thereby possible to arrange the aggregates necessary for the generation of the toner image in a space-saving manner on both sides of the photoconductor web 12 along this longitudinal axis. The length of the photoconductor band 12 is selected such that sufficient space remains for the aggregates still to be described.

As shown in FIG. 1, the photoconductor band 12 is directed to a plurality of rollers 30. A tensioning element 32 with a roller can be switched into two positions. In the illustrated position, the photoconductor band 12 is under tension. In the other (not shown) position, the mechanical tension of the photoconductor band 12 is reduced. In this position, the photoconductor band 12 can be exchanged or maintenance work can be effected.

A two-color toner image can be generated on the photoconductor band 12 with the aid of the printing group 10. Viewed in the rotation direction of the photoconductor band 12, a cleaning corotron 34 and a cleaning station 36 are arranged after the transfer printing corotron 22. Both aggregates have the function to remove still-present residual toner from the photoconductor band 12 after the printing at the transfer printing location 16 in order to bring the photoconductor band 12 into an output state defined for the subsequent exposure and reapplication of toner. To generate a first toner image, a first charge corotron 38 is provided which generates a defined charge state on the surface of the photoconductor band 12. The charge image is subsequently influenced, corresponding to the print image to be printed, with the aid of a first character generator 40, for example with the aid of a laser or with the aid of LEDs or an LED comb. The charge image is subsequently inked with a toner of a first color with the aid of the first developer station 42.

In the further process, the photoconductor band 12 is directed to a second charge corotron 44, a second character generator 46 and a second developer station 48. Given circulation of the photoconductor band 12, a first latent charge image is generated on the photoconductor band 12 via the first charge corotron 38 and the first character generator 40, and a first toner image is generated on the photoconductor band 12 via the first developer station 42. In combination with the second charge corotron 44, the second character generator 46 subsequently generates (via superimposition on the developed first charge image) a second latent charge image which is inked with a toner of a second color by the second developer station 48. A second toner image is thus superimposed on the first toner image on the photoconductor band 12. The resulting toner image is two-color and is transferred onto the surface of the individual page 18 at the transfer printing location 16. In this manner a two-color toner image can be printed at the transfer printing location 16 with high speed. It is also possible to arrange along the photoconductor band 12 a further charge corotron, a further exposure unit and a further developer station in order to superimpose on the personal computer band 12 more than two toner images that are then mutually transferred onto the individual page 18.

Figure 2:
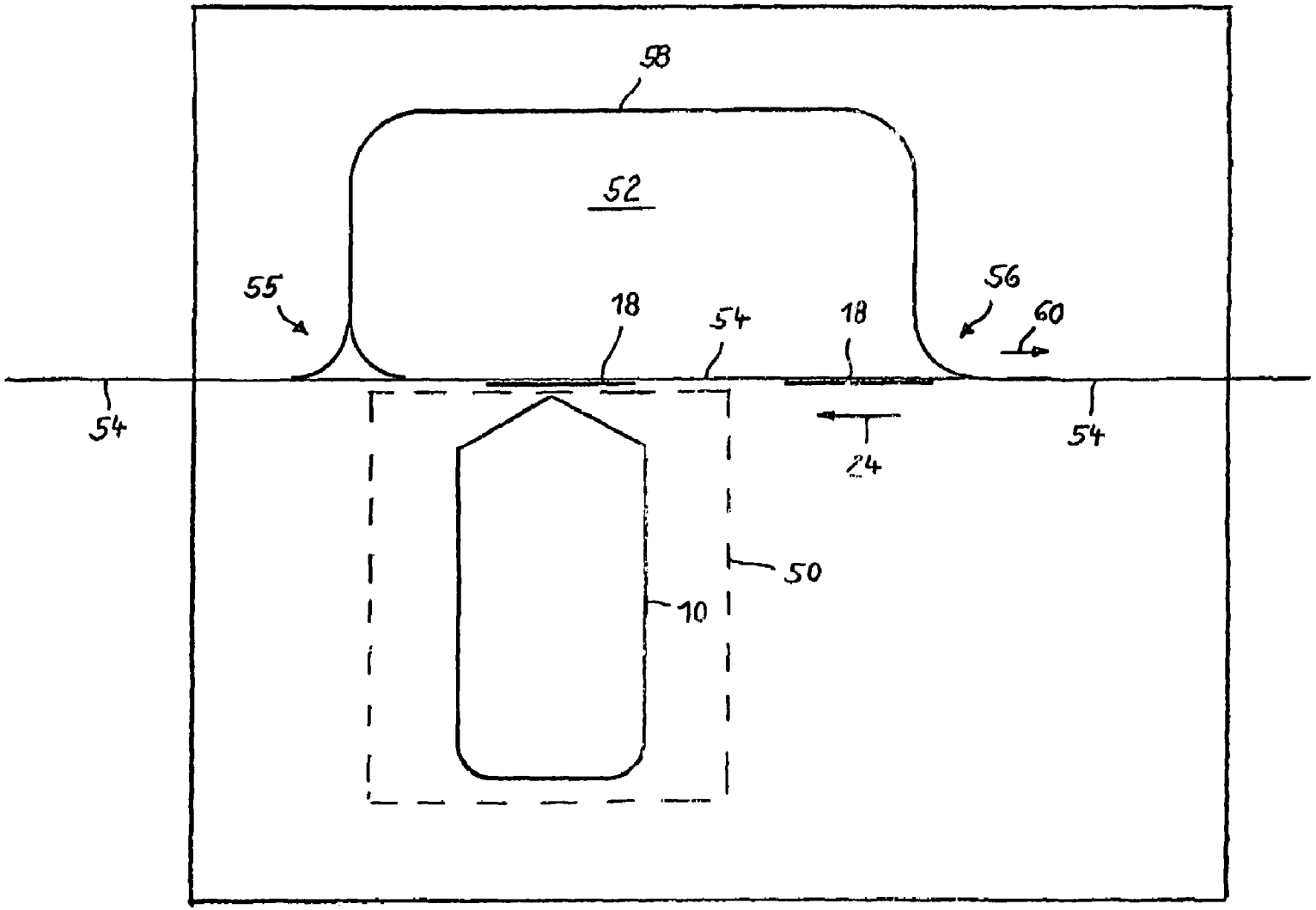
FIG. 2 is a principle representation of an exemplary embodiment with a printing device that comprises a printing group as well as with an inverter.

FIG. 2 shows an embodiment of the printing device. The printing device has a printing unit 50 that comprises a printing group 10 according to FIG. 1. This printing group 10 prints the individual page 18 in the shown state. This individual page 18 is directed along a guideway 54, for example with the aid of controlled roller actuators. In the operating mode "simplex operation", in which the individual pages 18 are only printed one-color or multicolor on one side with the printing group 10, these individual pages 18 run in a straight path along the guideway 54.

In a "duplex operation" in which the individual pages 18 are printed one-color or multicolor on both sides, these individual pages 18 traverse an inverter 52 that inverts the individual pages 18 after the first printing event at the printing group 10 and re-supplies them to the printing group 10 for printing on the other side. The inverter 52 comprises a switch 55 downstream from the printing unit 50 and a switch 56 upstream from the printing unit 50 and a return path along which the individual pages 18 are conveyed.

The downstream switch 55 has three operating states. In the first operating state, the switch 55 allows an individual page 18 arriving from the printing unit 50 through undeflected, such that this individual page 18 is further conveyed straight ahead along the guideway 54. In a second operating setting, the switch 55 deflects the individual pages 18 arriving from the printing unit 50 into the return path 58. This return path 58 conveys the individual pages to the upstream switch 56. This switch 56 is executed as an inverting switch. The page printed by the printing unit 50 lies on top in the conveyance along the return path 58. The individual page 18 is initially transported by the switch 56 in the direction of the arrow 60 for a predetermined inversion length, meaning the switch 56 conveys the individual page directed via the return path 58 into the guideway 54. The transport direction for the individual page 18 henceforth located in the guideway 54 is then reversed, meaning the transport direction is now counter to the transport direction 60. The switch 56 is then switched such that this individual page 18 is further transported straight ahead, such that it can be re-supplied to the printing unit 50 for printing. The switches 55 and 56 thus cooperate such that the individual page 18 printed once can be directed back along the return path 58 and can be re-supplied along the guideway 54 to the same printing unit 50 and is then directed out from the printing device after reprinting.

The switches 55 and 56 can also cooperate in a further operating mode, the "bypass operating mode", such that the individual pages 18 arriving along the guideway 54 are conveyed to the return path via the switch 56 and are deflected into the guideway 54 by the switch 55. In this operating mode, the individual pages 18 are thus conveyed into the printing device under omission of the printing unit 50 in order, for example, to transport unprinted intermediate pages via the printing device.

Figure 3:
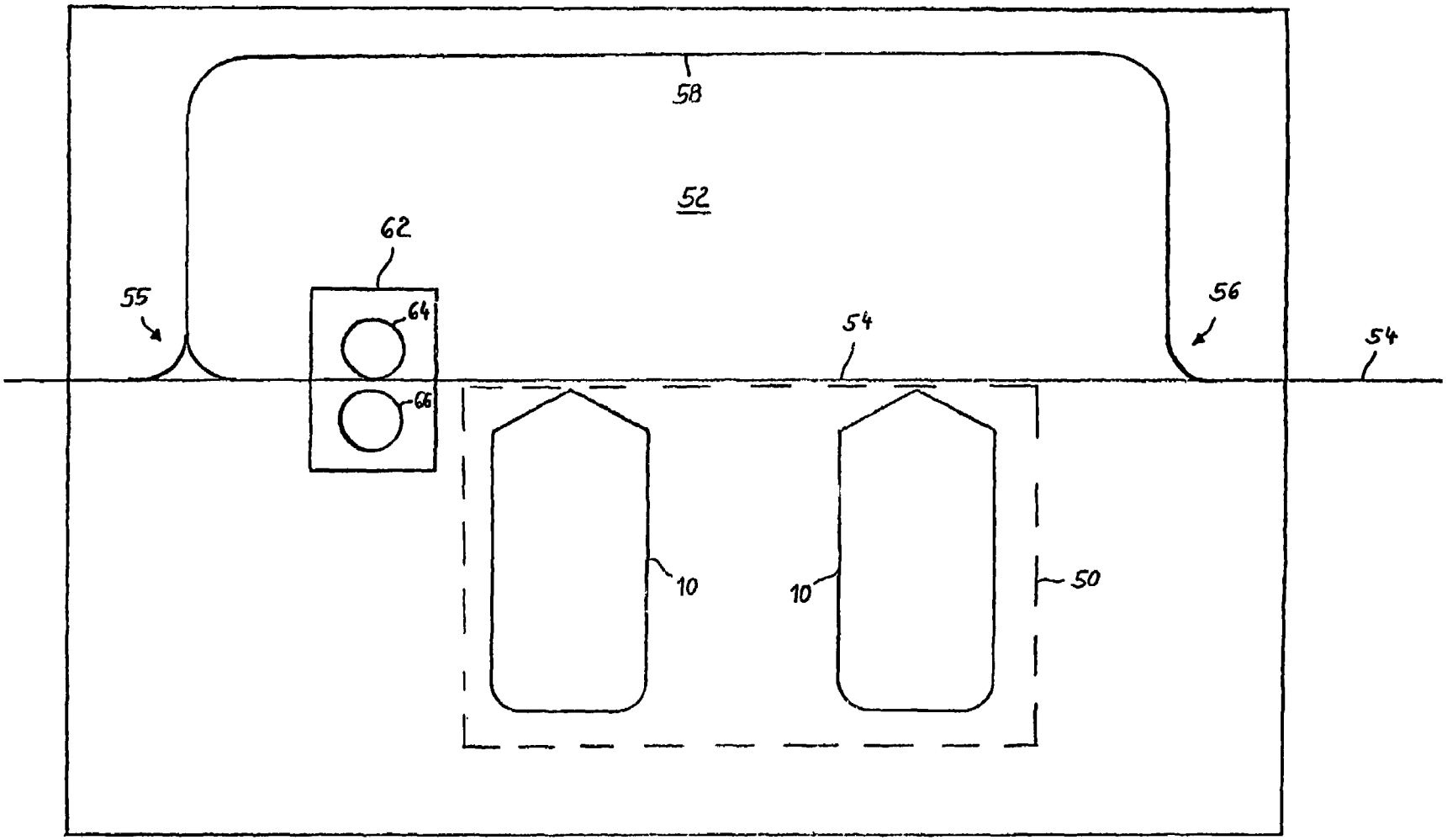
FIG. 3 is an example with two printing groups.

FIG. 3 shows a further variation. The printing unit 50 here comprises two similar printing groups 10 that are arranged in series. Each printing group 10 prints two-color toner images. In this manner, a four-color duplex operation can be realized, i.e. respectively the front side and the backside of the individual pages can be printed with four different-colored image patters. For example, in this manner a full-color printing with the four process colors "yellow, magenta, cyan and black" is possible, whereby each of the two printing groups 10 prints two of the process colors.

A fixing station that realizes a fixing of the multicolor toner image printed by the printing unit 50 is downstream from the printing unit 50. For example, a fixing can occur under pressure and heating temperature with the aid of rollers 64, 66. Alternatively, an infrared radiation fixing or also a combination of radiation fixing and roller fixing can occur. After the fixing of the toner image, the individual pages are inverted in the inverter 52 and re-supplied to the printing unit 50 in order to print the backside of the individual pages in multicolor printing. A fixing station 62 which is arranged between the printing unit 50 and the downstream switch 55 is also necessary in the example according to FIG. 2.

Numerous variations are possible. The printing group 10 can also operate according to another method than the specified electrostatic image generation method, for example according to a magnetic method. In addition to a photoconductor band 12, a photoconductor drum can also be used as a toner intermediate carrier.

Although preferred exemplary embodiments are displayed and described in detail in the drawings and in the preceding specification, these should be viewed as purely exemplary and not as limiting the invention. It is to be noted that only the preferred exemplary embodiments are shown and described, and all variations and modifications that lie within the scope of protection of the invention at present and in the future should be protected.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

I claim as my invention:

1. An electrophotographic printing device, comprising:

a guideway which transports individual pages of a print medium;

a printing unit opposite the guideway which prints a side of the respective individual pages facing it;

a fixing station immediately downstream from the printing unit which fixes an applied toner image;

an inverter that inverts the individual pages with the fixed toner image after a first printing event and re-supplies them to the printing unit for printing on another side;

the printing unit comprising at least first and second printing groups that each respectively comprise first and second exposure units, first and second charge corona devices and first and second developer stations arranged along an extent of a respective toner carrier, the individual pages being immediately supplied in succession to both printing groups, and the first and second printing groups each respectively printing two varicolored print images on the same side of the same individual page for a total of four of said print images on said same individual page;

the first printing group first exposure unit generating a first latent charge image which is inked with a first color toner at said first developer station, and said first printing group second exposure unit generating a second latent charge image which is inked with a second color toner at said second developer station given circulation of the toner carrier, the second exposure unit generating said second latent charge image via superimposition on the developed first latent charge image so that a second color toner image is thus superimposed on a first color toner image on the toner carrier;

the second printing group first exposure unit generating a third latent charge image which is inked with a third color toner at said first developer station, and said second printing group second exposure unit generating a fourth latent charge image which is inked with a fourth color toner at said second developer station given circulation of the toner carrier, the second exposure unit generating said fourth latent charge image via superimposition on the developed third latent charge image so that a fourth color toner image is thus superimposed on a third color toner image on the toner carrier; and said first through fourth different respective color toners being used in the respective first and second developer stations of the first printing group and the respective first and second developer stations of the second printing group to perform four color printing of the print images with each of the colors being different to achieve full color printing of the print images.

2. A printing device according to claim 1 in which the first and second developer stations have varicolored toner.

3. A printing device according to claim 1 in which the toner carrier comprises a toner carrier band.

4. A printing device according to claim 1 in which the four different colors comprise yellow, magenta, cyan and black for said four color printing to achieve said full color printing of the print images.

5. A printing device according to claim 1 in which the inverter comprises a switch downstream from the printing unit, a return path, and a switch upstream from the printing unit.

6. A printing device according to claim 5 in which the downstream switch in a first operating setting passes individual pages without deflection.

7. A printing device according to claim 5 in which the downstream switch in a second operating setting deflects the individual pages arriving from the printing unit into the return path.

8. A printing device according to claim 5 in which the downstream switch conveys the individual pages arriving from the printing unit into the guideway.

9. A printing device according to claim 5 in which the upstream switch in an inversion operating setting conveys an individual page arriving from the return path around a predetermined inversion length in the guideway opposite to a normal conveyance direction of the individual pages, and in which the upstream switch then conveys the individual page along the guideway in a direction of the printing unit.

10. A printing device according to claim 5 in which the upstream switch deflects arriving individual pages into the return path that supplies the individual pages to the downstream switch.

11. A method for printing, comprising the steps of:

transporting individual pages of a print medium along a guideway;

with a printing unit opposite the guideway, printing a side of the respective individual page facing it, and with a fixing station immediately downstream from the printing unit, fixing the applied toner image;

with an inverter, inverting the individual pages with the fixed toner image after the first printing event and resupplying them to the printing unit for printing on an other side;

providing the printing unit with at least first and second printing groups that each respectively comprise first and second exposure units, first and second charge corona devices, and first and second developer stations arranged along an extent of a respective toner carrier, individual pages being immediately supplied in succession to both of the first and second printing groups, and the printing groups each respectively printing two varicolored print images on the same side of the same individual page for a total of four of said print images on said same individual page;

generating with the first printing group first exposure unit a first latent charge image which is inked with a first color toner at said first developer station, and said first printing group second exposure unit generating a second latent charge image which is inked with a second color toner at said second developer station given circulation of the toner carrier, the second exposure unit generating said second latent charge image via superimposition on the developed first latent charge image so that a second color toner image is thus superimposed on a first color toner image on the toner carrier;

with the second printing group first exposure unit generating a third latent charge image which is inked with a third color toner at said first developer station, and said second printing group second exposure unit generating a fourth latent charge image which is inked with a fourth color toner at said second developer station given circulation of the toner carrier, the second exposure unit generating said fourth latent charge image via superimposition on the developed third latent charge image so that a fourth color toner image is thus superimposed on a third color toner image on the toner carrier; and said first through fourth four different respective color toners being used in the respective first and second developer stations of the first printing group and the respective first and second developer stations of the second printing group to perform four color printing of the print images with each of the colors being different to achieve full color printing of the print images.

12. A method according to claim 11 in which the toner carrier comprises a continuous toner carrier band.

13. A method according to claim 11 in which the four different colors comprise yellow, magenta, cyan and black for said four color printing to achieve said full color printing of the print images.

14. A method according to claim 11 in which the inverter comprises a switch downstream from the printing unit, a return path and a switch upstream from the printing unit.

15. A method according to claim 14 in which the downstream switch in a first operating setting passes individual pages without deflection.

16. A method according to claim 14 in which the downstream switch in a second operating setting deflects the individual pages arriving from the printing unit into the return path.

17. A method according to claim 14 in which the downstream switch conveys the individual pages arriving from the printing unit into the guideway.

18. A method according to claim 14 in which the upstream switch in an inversion operating setting conveys an individual page arriving from the return path around a predetermined inversion length in the guideway opposite to a normal conveyance direction of the individual pages, and in which the upstream switch then conveys the individual page along the guideway in a direction of the printing unit.

19. A method according to claim 14 in which the upstream switch deflects arriving individual pages into the return path that supplies the individual pages to the downstream switch.

* * * * *